US006758047B1

(12) United States Patent
Giles

(10) Patent No.: US 6,758,047 B1
(45) Date of Patent: Jul. 6, 2004

(54) PORTABLE ICE STORAGE CONTAINER HAVING AN ICE DISPENSER DEVICE AND METHOD THEREFOR

(76) Inventor: Robert R. Giles, 385 Gleeson Rd., Box 1030, Tombstone, AZ (US) 85638

( * ) Notice: Subject to any disclaimer, the term of this patent is extended or adjusted under 35 U.S.C. 154(b) by 0 days.

(21) Appl. No.: 10/410,776

(22) Filed: Apr. 9, 2003

(51) Int. Cl.[7] ..... F25C 5/18
(52) U.S. Cl. ..... 62/66; 62/344; 222/146.6
(58) Field of Search ..... 62/344, 66; 222/146.6

(56) References Cited

U.S. PATENT DOCUMENTS 4,084,725 A * 4/1978 Buchser ..... 221/75
4,252,002 A * 2/1981 Mullins, Jr. ..... 62/344
4,997,109 A * 3/1991 Carper ..... 222/146.6
5,117,654 A * 6/1992 Steffenhagen ..... 62/344
5,211,030 A * 5/1993 Jameson ..... 62/344
5,240,150 A * 8/1993 Palmon ..... 222/216
5,560,221 A * 10/1996 Snelling et al. ..... 62/344
5,921,103 A * 7/1999 Hilsinger ..... 62/340
5,947,342 A * 9/1999 Song ..... 222/413
6,176,099 B1 * 1/2001 Hynes ..... 62/344
6,405,553 B1 * 6/2002 Willett ..... 62/298

* cited by examiner

*Primary Examiner*—William E. Tapolcai
(74) *Attorney, Agent, or Firm*—Jeffrey D. Moy; Harry M. Weiss; Weiss, Moy & Harris, P.C.

(57) ABSTRACT

A portable ice storage and dispensing device has a portable container for housing the ice to be dispensed. An opening is formed on the portable insulated container. The opening is used for dispensing the ice out of the portable insulated container. An ice dispenser is located internal to the portable insulated container and extends partially out of the portable insulated container. The ice dispenser is used for moving and directing the ice out of the opening.

17 Claims, 2 Drawing Sheets

PORTABLE ICE STORAGE CONTAINER HAVING AN ICE DISPENSER DEVICE AND METHOD THEREFOR

BACKGROUND OF THE INVENTION

1. Field of the Invention

This invention relates generally to a portable cooler and, more specifically, to a portable cooler which will store and dispense ice without an individual having to use his/her hands to grab or scoop the ice from the portable cooler.

2. Description of the Prior Art

Golf has become one of the fastest growing sports throughout the world. Each year, more and more people are playing golf. In states with nice year around temperatures, golf courses are busy all year long. This is especially true in states like Arizona, California, and Florida.

Unfortunately, in recent months, people who have gone golfing have become sick after drinking water in water containers which were provided on the golf course. Many of these golfer suffered what is commonly called the Norwalk virus. The Norwalk virus is caused by drinking water contaminated with stool from an infected person. In most cases, people who come down with the Norwalk virus will suffer from nausea, vomiting, diarrhea, fever and headaches. However, in some extreme cases, people have been know to die from the Norwalk virus.

Because of these recent outbreaks of the Norwalk virus, many golf courses have been forced to changed how they supply water and ice to golfers. Many golf courses now prevent ice from being dispensed manually from a ice chest to a cup for fear that the person dispensing the ice may contaminate the ice. Some golf courses have thought of prepackaging the ice in cups to dispense to golfers on the course. However, when the temperature begins to rise in the summer months, the prepackaged ice will tend to melt fairly quickly.

Therefore, a need existed to provide a portable ice chest with an ice dispensing mechanism. The portable ice chest with the ice dispensing mechanism must allow one to dispense ice from the ice chest without having his/her hands come in contact with the ice.

SUMMARY OF THE INVENTION

In accordance with one embodiment of the present invention, it is an object of the present invention to provide a portable ice chest with an ice dispensing mechanism.

It is another object of the present invention to provide a portable ice chest with an ice dispensing mechanism that allows one to dispense ice from the ice chest without having his/her hands come in contact with the ice.

BRIEF DESCRIPTION OF THE EMBODIMENTS

In accordance with one embodiment of the present invention, a portable ice storage and dispensing device is disclosed. The portable ice storage and dispensing device has a portable container for housing the ice to be dispensed. An opening is formed on the portable insulated container. The opening is used for dispensing the ice out of the portable insulated container. An ice dispenser is located internal to the portable insulated container and extends partially out of the portable insulated container. The ice dispenser is used for moving and directing the ice out of the opening.

In accordance with another embodiment of the present invention, a portable ice storage and dispensing device is disclosed. The portable ice storage and dispensing device has a portable insulated container for housing the ice to be dispensed. An opening is formed on the portable insulated container. The opening is used for dispensing the ice out of the portable insulated container. An ice dispenser is located internal to the portable insulated container and extends out of the portable insulated container for moving and directing the ice out of the opening. The ice dispenser has an elongated rod member rotatably coupled to the portable container. A plurality of winged members are coupled to the elongated rod member for moving the ice out of the portable container. A guide member is coupled to the opening to move the ice in a desired direction.

In accordance with another embodiment of the present invention, a method of providing a portable ice storage and dispensing device is disclosed. The method comprising: providing a portable insulated container for housing the ice to be dispensed; providing an opening formed on the portable insulated container for dispensing the ice out of the portable insulated container; and providing an ice dispenser located internal to the portable insulated container and extending out of the portable insulated container for moving and directing the ice out of the opening.

The foregoing and other objects, features, and advantages of the invention will be apparent from the following, more particular, description of the preferred embodiments of the invention, as illustrated in the accompanying drawings.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

DETAILED DESCRIPTION OF THE PREFERRED EMBODIMENT

Figure 1:
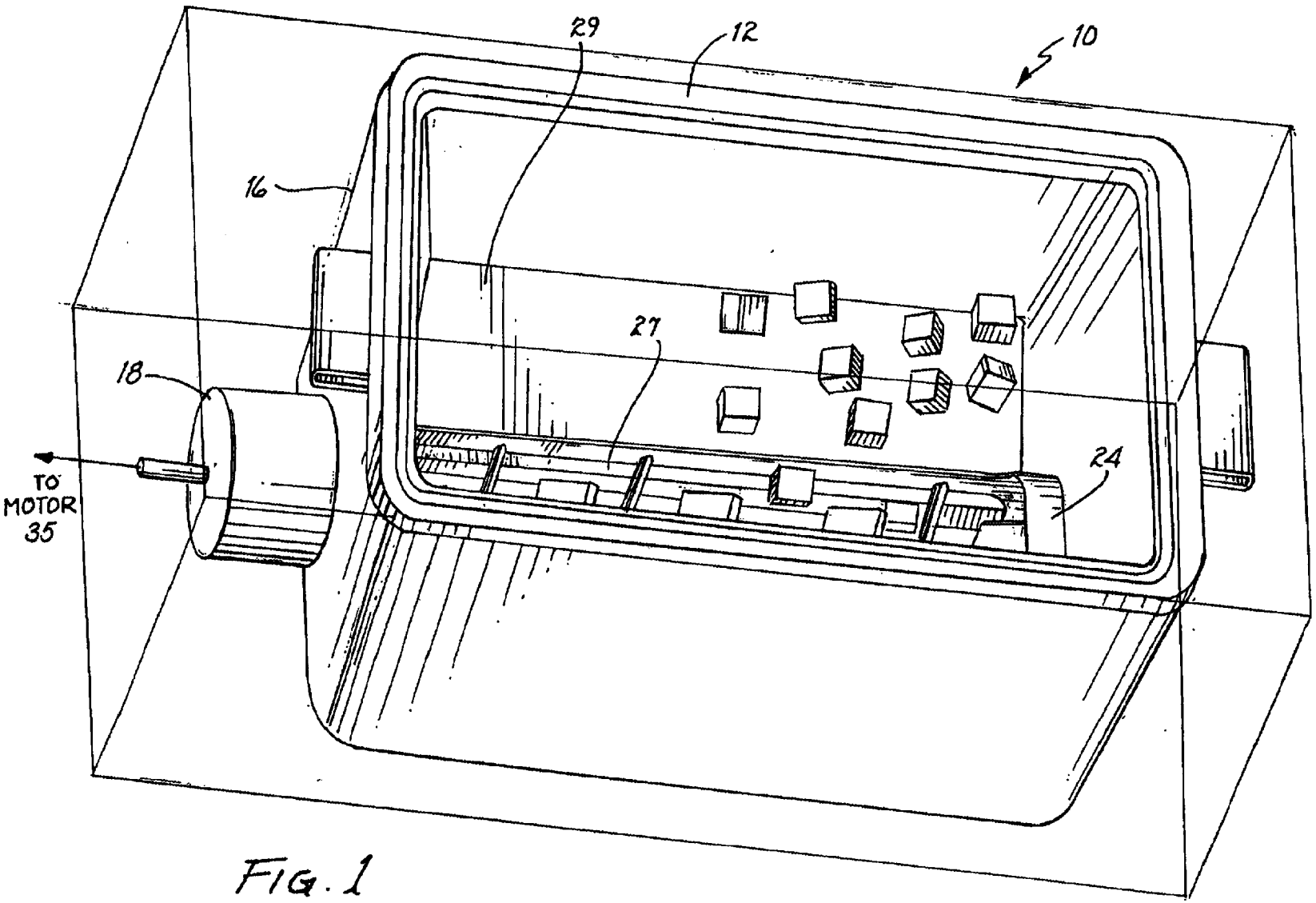
FIG. 1 is an elevated perspective view of the portable ice chest with an ice dispensing mechanism of the present invention with the top lid removed.
Figure 2:
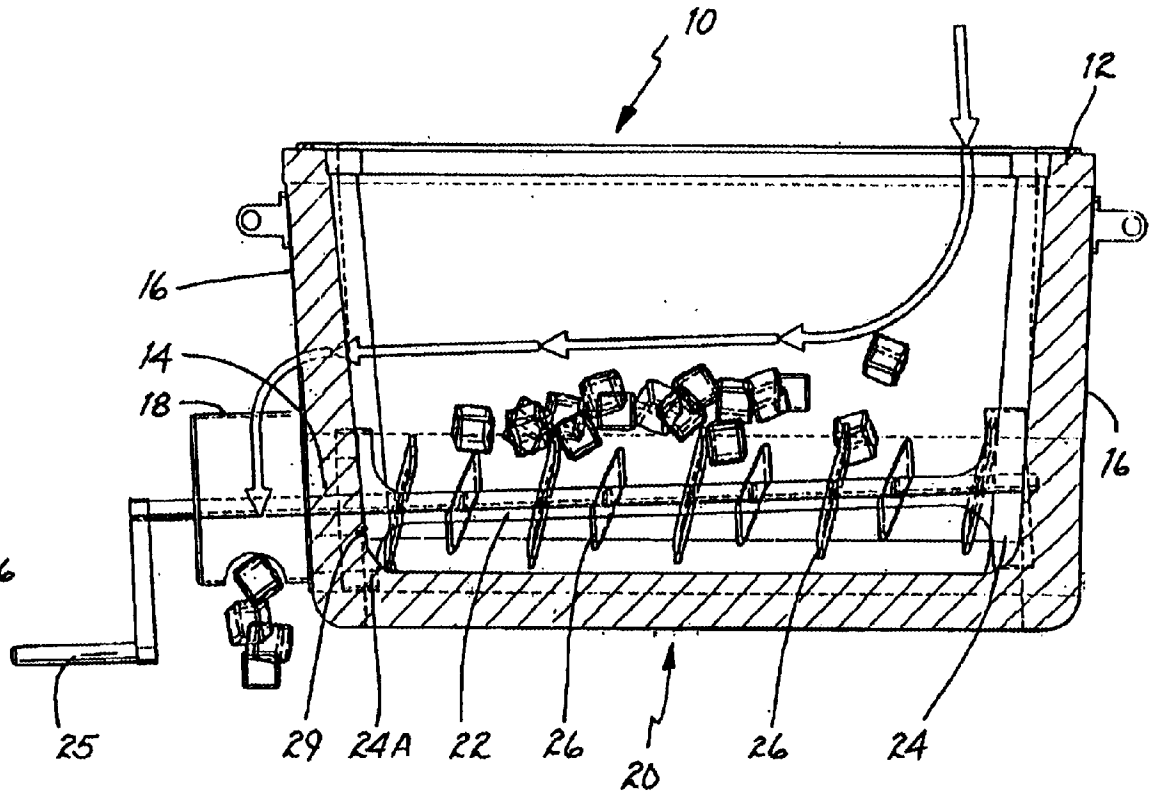
FIG. 2 is a cross sectional side view of the portable ice chest with an ice dispensing mechanism of the present invention.
Figure 3:
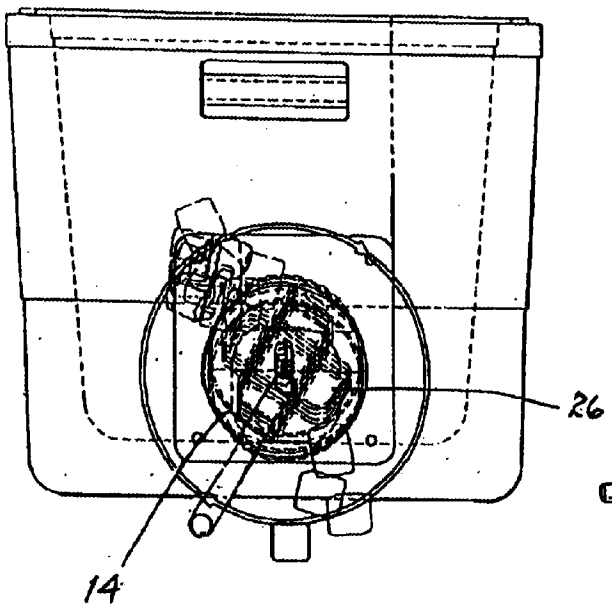
FIG. 3 is a front view of the portable ice chest with an ice dispensing mechanism of the present invention.

Referring to FIGS. 1–3, a portable ice chest with an ice dispensing mechanism 10 (hereinafter ice chest 10) is shown. The ice chest 10 will allow one to store and dispense ice into a cup or other container without one having to handle the ice. Thus, the ice chest 10 will have valuable health benefits by lessening the chances of a person contaminating the ice by having to handle and dispense the ice.

The ice chest 10 will have an ice storage container 12 (hereinafter container 12). The container 12 is used to store the ice which will be dispensed. The container 12 is generally, an insulated container 12. An insulated container 12 is preferred in order to keep the ice from melting The container 12 may come in various sizes and shapes. However, in general, a rectangular container 12 similar in size and shape to current ice chests are used. A lid 13 is movably coupled to the container 12. The lid 13 is used to enclose the container 12 in order to keep the ice from melting. The lid 13 is generally insulated as well. The lid 13 may be moved in an open and closed position in order to insert more ice into the container 12.

An opening 14 is formed through the container 12. The opening may be located anywhere on the container 12. However, in general, the opening 14 is formed on one of the smaller side walls 16. The opening 14 is where ice will be dispensed from the container 12. A guide member 18 may be coupled to the opening 14. The guide member 18 is used to direct the ice out in a downward manner so that the ice may more easily be dispensed into a cup or other container. The guide member 18 is generally a small housing which will fit over the opening 14. The housing will have an opening at a bottom section to allow the ice to exit the housing into a cup/container. The guide member 18 may be made of any material. Stainless steel has been used as the guide member 18. Stainless steel was used since this metal seems to have properties which resist bacteria growth. However, this should not be seen as to limit the scope of the present invention. Other material like plastic, fiberglass, and the like may be used.

An ice dispensing device 20 is located internally within the container 12. The ice dispensing device 20 will allow one to dispense ice out of the container 12 and out the guide member 18 without one having to manually pick or scope the ice with one's hand or with an ice scooper. The ice dispensing device 20 may be made out of a plurality of different materials. Stainless steel has been used since this metal seems to have properties which resist bacteria growth. However, this should not be seen as to limit the scope of the present invention. Other material like plastic, fiberglass, and the like may be used.

The ice dispensing device 20 has an elongated rod member 22. The rod member 22 generally extends from one side wall 16 of the container 12 to the opposite side wall 16. The rod member 22 will generally protrude out of the container 12 and be rotatably coupled to the guide member 18. The other end of the rod member 22 is rotatably coupled to the side wall 16. A reenforcement plate 24 may be positioned on the interior of the container 12 on the side wall 16. The reenforcement plate 24 will provide additional support and stability when using the ice dispensing device 20.

Coupled to the rod member 22 are a plurality of wing members 26. The wing members 26 will be coupled to the rod member 22 so that the wing members 26 are angled at different positions. The wing members 26 are used to move the ice towards the opening 14 in the container 12 when the rod member 26 is rotated so that the ice may be dispensed.

Located at the rod member 22 is a handle section 25. The handle section 25 is used to rotate the rod member 22. In operation, one will rotate the handle section 25. The rotation of the handle section 25 will rotate the rod member 22 and hence the wing members 26. The wing members 26 will move and direct the ice towards the opening 14 and dispense the ice out through the guide member 18.

A channeling 27 could also form part of the ice dispensing device 20. The channeling 27 would be a "U" shape channeling 27 which is coupled to a bottom section of the container 12. The channeling 27 is positioned so that one end of the channeling 27 is aligned with the opening 14. Thus, the channeling 27 will help to direct the ice out of the opening 14 when the ice dispensing device 20 is used. In accordance with one embodiment of the present invention, the reenforcement plate 24 is coupled to one end of the channeling 27. A second reenforcement plate 24A is coupled to the other end of the channeling 27. The second reenforcement plate 24A will have an opening 29. The opening is aligned with the opening 14 to allow the ice to be moved out of the container 12.

The container 12 may also have a sloped interior member 29. The sloped interior member 29 will help force the ice in a downward manner so that the ice dispensing device 20 can more easily dispense the ice out of the container 12 and out the guide member 18.

It should be noted that a small motor 35 could be coupled to the rod member 22. The motor may be an AC or DC motor. However, a small DC motor would probably be used since a DC motor could be coupled to a DC power source on a motorized beverage cart. The motor would further be coupled to a switch. When moving the switch to an "ON" position, the motor would rotate the rod member 22 and dispense the ice. Once the ice is dispensed, the switch may be moved to an "OFF" position thereby turning off the motor and stopping the dispensing of the ice.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A portable ice storage and dispensing device comprising:

a portable container for housing the ice to be dispensed, wherein the portable container comprises:

a bottom insulated wall section;

a plurality of insulated walls coupled together to the bottom insulated wall forming an enclosed container having an opened top; and an insulated lid movably coupled to the plurality of insulated walls for opening and closing the portable container;

an opening formed on the portable container for dispensing the ice out of the portable container; and an ice dispenser located internal to the portable container and extending out of the portable container for moving and directing the ice out of the opening.

2. A portable ice storage and dispensing device in accordance with claim 1 further comprising a guide member coupled to the opening to move the ice in a desired direction.

3. A portable ice storage and dispensing device in accordance with claim 1 wherein the portable container is insulated.

4. A portable ice storage and dispensing device in accordance with claim 1 wherein the ice dispenser comprises:

an elongated rod member rotatably coupled to the portable container; and a plurality of winged members coupled to the elongated rod member for moving the ice out of the portable container.

5. A portable ice storage and dispensing device in accordance with claim 4 wherein the ice dispenser further comprises a handle coupled to the elongated rod member for rotating the elongated rod member.

6. A portable ice storage and dispensing device in accordance with claim 5 wherein the ice dispenser further comprises:

a channeling for transporting the ice out of the opening formed on the portable insulated container;

a first reenforcement member coupled to channeling and to a sidewall of the portable container; and a second reenforcement member coupled to the channeling and to a second sidewall of the portable container wherein the second reenforcement member has an opening aligned with the opening formed on the portable insulated container.

7. A portable ice storage and dispensing device in accordance with claim 1 further comprising a motor coupled to the ice dispenser for powering the ice dispenser.

8. A portable ice storage and dispensing device comprising:

a portable insulated container for housing the ice to be dispensed, wherein the portable insulated container comprises:

a bottom insulated wall section;

a plurality of insulated walls coupled together to the bottom insulated wall forming an enclosed container having an opened top; and an insulated lid movably coupled to the plurality of insulated walls for opening and closing the portable container;

an opening formed on the portable insulated container for dispensing the ice out of the portable insulated container;

an ice dispenser located internal to the portable insulated container and extending out of the portable insulated container for moving and directing the ice out of the opening wherein the ice dispenser comprises:

an elongated rod member rotatably coupled to the portable container; and a plurality of winged members coupled to the elongated rod member for moving the ice out of the portable container; and a guide member coupled to the opening to move the ice in a desired direction.

9. A portable ice storage and dispensing device in accordance with claim 8 wherein the ice dispenser further comprises a handle coupled to the elongated rod member for rotating the elongated rod member.

10. A portable ice storage and dispensing device in accordance with claim 9 wherein the ice dispenser further comprises:

a channeling for transporting the ice out of the opening formed on the portable insulated container;

a first reenforcement member coupled to channeling and to a sidewall of the portable container; and a second reenforcement member coupled to the channeling and to a second sidewall of the portable container wherein the second reenforcement member has an opening aligned with the opening formed on the portable insulated container.

11. A portable ice storage and dispensing device in accordance with claim 8 further comprising a motor coupled to the ice dispenser for powering the ice dispenser.

12. A method of providing a portable ice storage and dispensing device comprising:

providing a portable insulated container for housing the ice to be dispensed, wherein providing the portable insulated container further comprises:

providing a bottom insulated wall section;

providing a plurality of insulated walls coupled together to the bottom insulated wall forming an enclosed container having an opened top; and providing an insulated lid movably coupled to the plurality of insulated walls for opening and closing the portable container;

providing an opening formed on the portable insulated container for dispensing the ice out of the portable insulated container; and providing an ice dispenser located internal to the portable insulated container and extending out of the portable insulated container for moving and directing the ice out of the opening.

13. The method of claim 12 further comprising providing a guide member coupled to the opening to move the ice in a desired direction.

14. The method of claim 12 wherein providing the ice dispenser comprises:

providing an elongated rod member rotatably coupled to the portable container; and providing a plurality of winged members coupled to the elongated rod member for moving the ice out of the portable container.

15. The method of claim 14 wherein providing the ice dispenser further comprises providing a handle coupled to the elongated rod member for rotating the elongated rod member.

16. The method of claim 15 wherein providing the ice dispenser further comprises:

providing a channeling for transporting the ice out of the opening formed on the portable insulated container;

providing a first reenforcement member coupled to channeling and to a sidewall of the portable container; and providing a second reenforcement member coupled to the channeling and to a second sidewall of the portable container wherein the second reenforcement member has an opening aligned with the opening formed on the portable insulated container.

17. The method of claim 12 further comprising providing a motor coupled to the ice dispenser for powering the ice dispenser.

* * * * *